US006350147B2

(12) United States Patent
Brownell et al.

(10) Patent No.: US 6,350,147 B2
(45) Date of Patent: Feb. 26, 2002

(54) HIGH DENSITY ELECTRICAL CONNECTOR

(75) Inventors: Kenneth W. Brownell, Marion; John G. Shram, Weaverville, both of NC (US)

(73) Assignee: Superior Modular Products Incorporated, Swannanoa, NC (US)

( * ) Notice: Subject to any disclaimer, the term of this patent is extended or adjusted under 35 U.S.C. 154(b) by 0 days.

(21) Appl. No.: 09/775,358

(22) Filed: Feb. 1, 2001

Related U.S. Application Data

(63) Continuation of application No. 08/975,304, filed on Nov. 20, 1997.

(51) Int. Cl.[7] ..... H01R 13/58
(52) U.S. Cl. ..... 439/468
(58) Field of Search ..... 439/466, 468, 439/473

(56) References Cited

U.S. PATENT DOCUMENTS

| | | | | |
|---|---|---|---|---|
| 3,975,075 A | 8/1976 | Mason | | |
| 4,127,316 A | 11/1978 | McKee et al. | ..... | 439/468 |
| 4,211,463 A | 7/1980 | Chandler | ..... | 439/468 |
| 4,422,705 A | 12/1983 | Kasper | ..... | 439/473 |
| 4,583,799 A | 4/1986 | Wiley | | |
| 4,771,367 A | 9/1988 | Serr et al. | | |
| 4,842,547 A | 6/1989 | Defibaugh et al. | ..... | 439/466 |
| 5,076,802 A | 12/1991 | Colleran et al. | ..... | 439/468 |
| 5,167,530 A | 12/1992 | Wallgren et al. | ..... | 439/540 |
| 5,411,414 A | 5/1995 | House et al. | ..... | 439/540 |
| 5,562,479 A | 10/1996 | Pallas et al. | ..... | 439/404 |

OTHER PUBLICATIONS

Western Electric, "Side Entry Connector", Technical Digest, No. 55, p. 5. 439/468, dated Jul. 1979.

*Primary Examiner*—Gary Paunen
(74) *Attorney, Agent, or Firm*—Carter & Schnedler, P.A.

(57) ABSTRACT

There is provided a high density electrical connector for use on a panel which receives a plurality of closely spaced connectors. The connector includes two intermateable halves. One of the connector halves includes an elongated base having wire termination members on one side and associated electrical contacts on the other side. A hood covers the wire termination side of the base. An electrical cable containing a plurality of insulated wires enters on the side of the hood adjacent to a closely spaced adjoining connector at an angle greater than 0° but less than 90° with respect to the base so that the cable will clear the adjoining connector without the need to unduly bend the cable. The top of the hood may be sloped downwardly from its cable receiving side to the opposing side.

6 Claims, 5 Drawing Sheets

HIGH DENSITY ELECTRICAL CONNECTOR

RELATED APPLICATION

This is a continuation of U.S. Patent application Ser. No. 08/975,304, filed Nov. 20, 1997.

BACKGROUND OF THE INVENTION

This invention relates to electrical connectors. More particularly it relates to high density electrical connectors which are attached to panels where the connectors are closely spaced from one another.

A patch panel is used as an interface between common carrier telecommunication lines, a local area network hub, router, or data switch, and the end user equipment where the end user has a substantial number of lines to service telephones, work station computers, and other telecommunications and data communications equipment, such as modems and personal computers. Often a single patch panel will accommodate forty-eight separate lines. A patch panel, in general, consists of a printed circuit board, or a group of boards arranged end to end, having FCC RJ-45 jacks connected to one side and corresponding wire termination connectors attached the other side. The jacks connect the patch panel to the work station equipment through a patch cord and a second patch panel. The wire termination connectors connect the patch panel to the telephone equipment or computer equipment.

The terminated wires are often received in a twenty-five pair cable which is approximately 1 inch in diameter.

There is a growing trend to utilize standard, twenty-five pair ribbon connectors on the telephone or computer side of the circuit board because of the ease of terminating the wires in the cable to the connector, and the space savings and cost savings associated with one cable rather than multiple, individual cables, and so that specific circuits may be easily removed from service, i.e., the twenty-five pair connector is simply disconnected on the board. A typical twenty-five pair connector is sold under the brand name AMP CHAMP. The architecture for the twenty-five pair connector interface has been standardized by the FCC and is referred to as the RJ-21X. In general, half of the connector body is permanently attached to the telephone company or computer side of the circuit board while the other half of the connector body terminates the twenty-five pair cable. In many cases, this structure is repeated at the telephone or computer equipment also.

In the case of a patch panel having twenty-four ports on the customer side, there are normally four ribbon connectors attached to the telephone company side. In some cases, a single circuit board is used, however, more often, four separate adjacent circuit boards are used, but are assembled together so that the boards are in the same plane and are contiguous with one another. The half of the standard ribbon connector which terminates the wire in the cable includes a hood having an opening at one end which receives the cable. Because of this configuration, the cable exits the connector parallel to the circuit board. Due to space and architecture requirements, the connector halves which are attached to the circuit boards are arranged end-to-end in rows and are closely spaced to one another, i.e., often less than 1½ inches apart. With the cable exiting from the other half of the connector parallel to the circuit board, the cable must be severely bent near the exit from the connector hood, otherwise the connector halves cannot be intermated. This problem is illustrated in FIG. 1, which shows circuit board 10 having ribbon type connector halves 12 and 14 attached to the board while the other connector halves 16 and 18 terminate cables 20 and 22. As can be seen, cables 20 and 22 exit the connectors 16 and 18 at one end of their respective hoods 24 and 26 parallel to circuit board 10 resulting in bend 28 in cable 20. If the particular patch panel is a forty-eight port patch panel, there will be two additional ribbon connectors in line with the ribbon connectors shown in FIG. 1 so that two more cables will have to be bent. Bending a cable which carries high speed data, e.g., 100 MHz, will often degrade the signal transmission characteristics. On electronic equipment, this problem is even greater due to higher circuit density allowed by today's micro electronics. Connector spacing limits circuit density.

OBJECTS OF THE INVENTION

It is therefore one object of this invention to provide an improved high density electrical connector.

It is another object of this invention to provide an improved high density multiple connector patch panel, wherein each connector may be intermated without obstruction by its adjacent connector.

It is still another object of this invention to provide an elongated telecommunication connector, having a cable extending therefrom, which is used adjacent to another connector on a circuit board, whereby the cable need not be bent to avoid contact with the adjacent connector.

It is yet another object to provide an electrical telecommunication connector system for use with circuit boards, whereby the circuit density on the board is improved without degrading signal transmission characteristics.

SUMMARY OF THE INVENTION

In accordance with one form of this invention, there is provided an electrical connector for use in connecting an electrical cable having a plurality of wires to an associated substrate. The connector includes a first connector half and a second connector half. The first connector half is selectively connectable to the associated substrate. A base forms a part of the second connector half. The base carries a plurality of electrical contacts for terminating the plurality of wires and for making an electrical connection to the first connector half. A mechanism is juxtaposed to the base. The mechanism receives and holds the electrical cable at an angle greater than 0° but less than 90° relative to the base. A removable hood is selectively connectable with the base to cover the base and to form an enclosure with the base. The hood is a separate element from the base.

In accordance with one form of this invention, there is provided an electrical connector including a base. The connector base including a plurality of wire termination contacts. The connector includes a hood. The hood covers the base forming an enclosure with the base. The hood has an opening therein for receiving an electrical cable having a plurality of wires. A mechanism is provided to guide the cable into the hood and to hold the cable, where it enters the hood, at an angle greater than 0° but less than 90° with respect to the base. The hood includes a top and first and second ends. In one embodiment, the top slopes downwardly from the first end to the second end and the opening for receiving the cable is in the first end near the top.

In accordance with another form of this invention, there is provided an elongated twenty-five pair type connector having a wire termination side and a contact side. A hood covers the wire termination side of the connector. A cable containing insulated conductors is provided. The cable enters the hood at an angle greater than 0° but less than 90° with respect to the wire termination side of the connector.

In accordance with another form of this invention, there is provided a high density connector apparatus including a substrate which, preferably, is in the form of a circuit board. First and second electrical connectors are provided. Each connector includes first and second intermateable halves. The first halves are connected to the circuit board. The first halves are closely spaced and arranged end to end on the substrate. The second half of the first connector has a first base and a first hood and the second half of the second connector has a second base and a second hood. Each hood forms a part of an enclosure. Each hood has a first and second end. The first end of the first hood is adjacent to the second end of the second hood. The first hood has a top. A mechanism is provided to guide a cable into the first hood and to hold the cable, where it enters the hood, at an angle greater than 0° but less than 90° with respect to the first base. Preferably, the top of the first hood slopes downwardly from its first end to its second end. In one embodiment, the first hood has an opening in its first end near its top for receiving the cable which extends into the enclosure, thereby forming a mechanism for guiding and holding the cable. Because of the downward slope of the top of the hood and the position of the opening, the second connector does not interfere with the cable when the second half of the first connector is intermated with the first half.

In accordance with another form of this invention, there is provided a hood for an electrical connector having an elongated contact carrying base. The hood includes first and second sides, first and second ends, and a top and an open bottom. The bottom is adapted to be connected to the base. The hood and the base form an enclosure. The hood has an opening therein which serves to guide the cable, allowing the cable to exit the hood at an angle greater than 0° but less than 90° with respect to the connector body.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENTS

Figure 1:
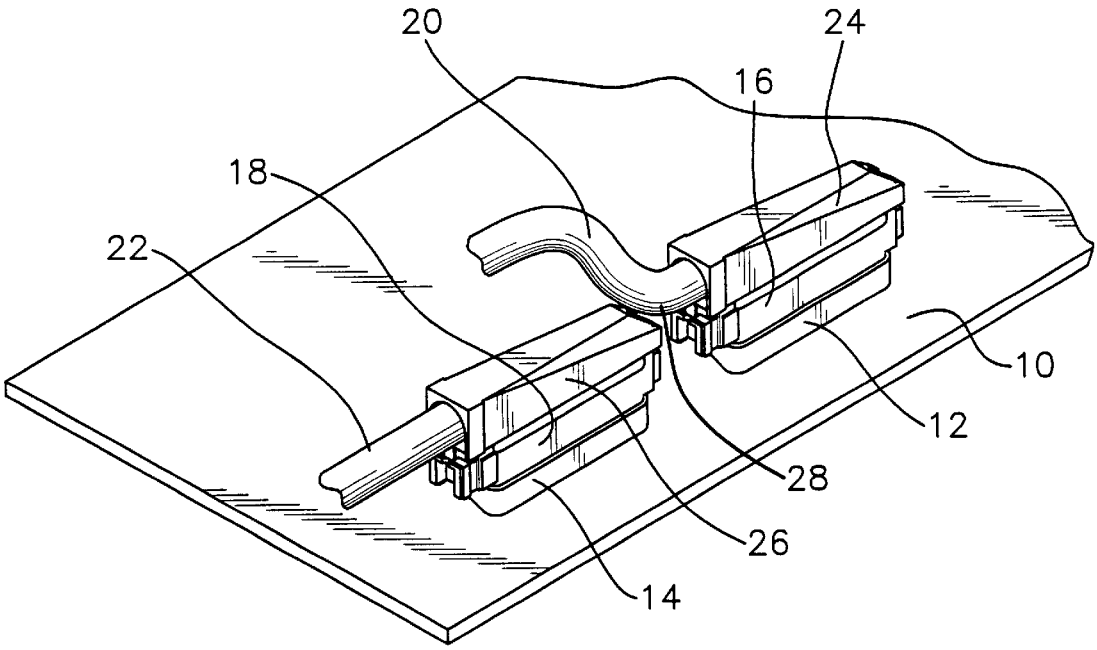
Fig. 1 Prior Art
FIG. 1 is a pictorial view of a prior art electrical connector system.
Figure 2:
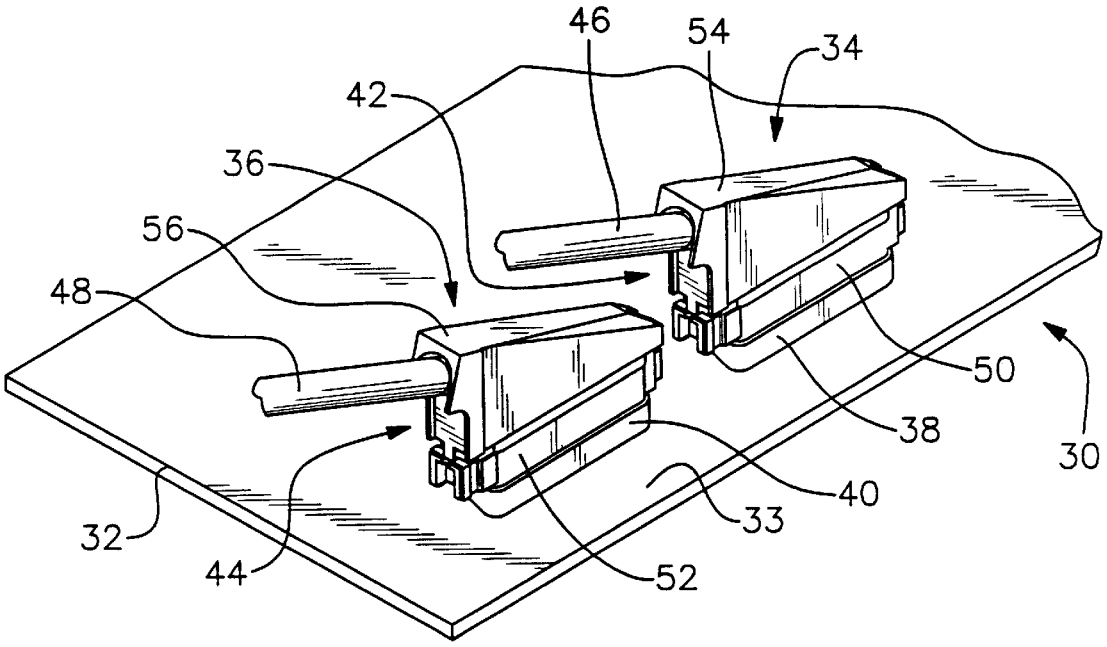
FIG. 2 is a pictorial view of a connector system showing connectors the present invention.

Referring now more particularly to FIG. 2, there is provided high density connector apparatus 30 including substrate 32 which, preferably, is in the form of a printed circuit board. When used herein, the term "substrate" or "printed circuit board" may mean a single substrate or single circuit board, or may also mean a plurality of substrates or circuit boards which are situated in a side by side co-planar arrangement.

The invention may be used with a patch panel, as described below. However, the invention is not limited to use with a patch panel. The invention may be used with other electrical equipment, such as computer equipment serving local area networks where high circuit density is important.

The apparatus 30 of FIG. 2 shows a portion of a patch panel having a plurality of telecommunication jacks attached to the front side (not shown) of circuit board 32. FIG. 2 shows the back side 33 of the circuit board. As previously stated, the front side of a patch panel board is connected to the end user's telecommunication or computer equipment while the back side is normally connected to the telephone or computer lines. The subject invention relates to the interconnections on the back side 33 of the circuit board.

FIG. 2 shows ribbon connectors 34 and 36, including first connector halves 38 and 40, which are arranged in a closely spaced end to end arrangement and are attached to the back side 33 of circuit board 32. Second connector halves 42 and 44 are used to terminate the twenty-five pair cables 46 and 48. Second connector halves 42 and 44 include connector bases 50 and 52 which intermate with first connector halves 38 and 40. Screws, nuts and other latching mechanisms (not shown) may be used to hold the first connector halves to the second connector halves. Angled hoods 54 and 56 are received over bases 50 and 52, and the hoods include openings at one end thereof for receiving cables 46 and 48.

In the preferred embodiment, connectors 34 and 36 are identical. Therefore, the discussion of the construction of these connectors will be primarily limited to connector 36.

Figure 3:
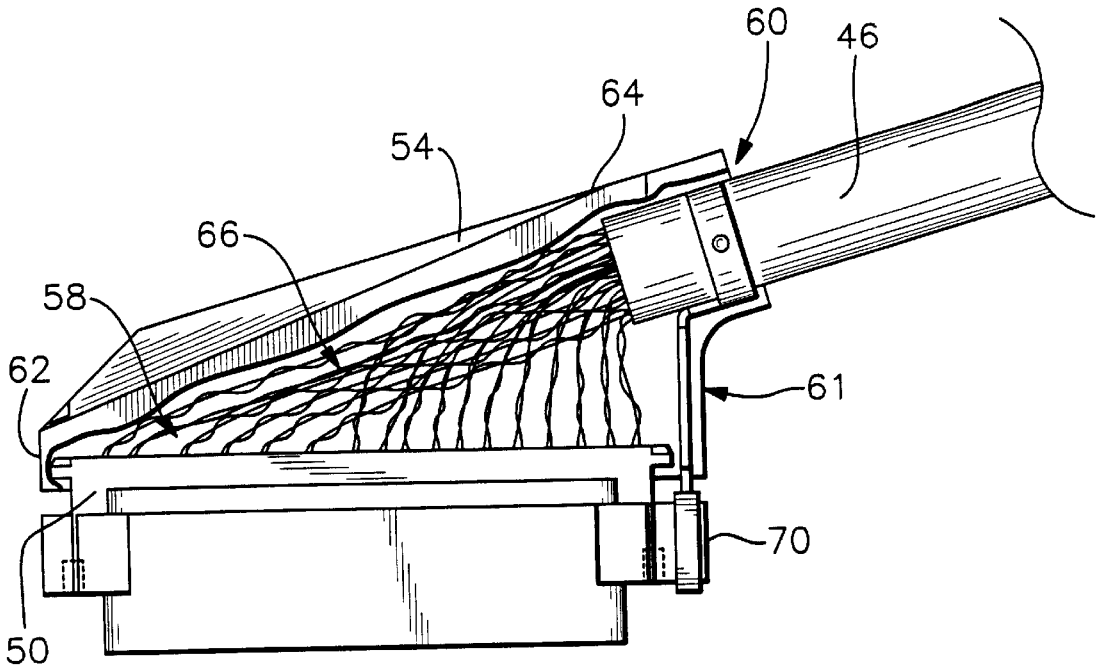
FIG. 3 is a side elevational view of one of the connectors of FIG. 2 having portions of the hood removed for illustrative purposes.

As can be better seen in reference to FIG. 3, hood 54 forms a cavity 58 with base 50. Cable 46 extends into cavity 58 through opening 60 in the first end 61 of hood 54 near the hood top 64. Hood 54 also includes a second end 62. End 61 is higher than end 62 so that top 64 slopes downwardly from end 61 to end 62. A plurality of insulated conductors 66 extend from cable 46 into cavity 58 and are terminated by conductor termination members 68, shown in FIG. 4, which are received in base 50.

Stud 70 extends from base 50 and receives a first clamp 72 of apparatus 74 which, along with opening 60, serves to guide and hold cable 46. Apparatus 74 includes a plate 76 and a second clamp 78 which is attached to cable 46. Apparatus 74 provides strain relief for the cable and, along with opening 60, also holds and guides cable 46 into cavity 58 and holds cable 46 at an angle greater than 0° but less than 90° with respect to the plane of circuit board 32, as well as with respect to the plane formed by the top surface 80 of base 50. In the preferred embodiment, the angle is approximately 15°.

Figure 4:
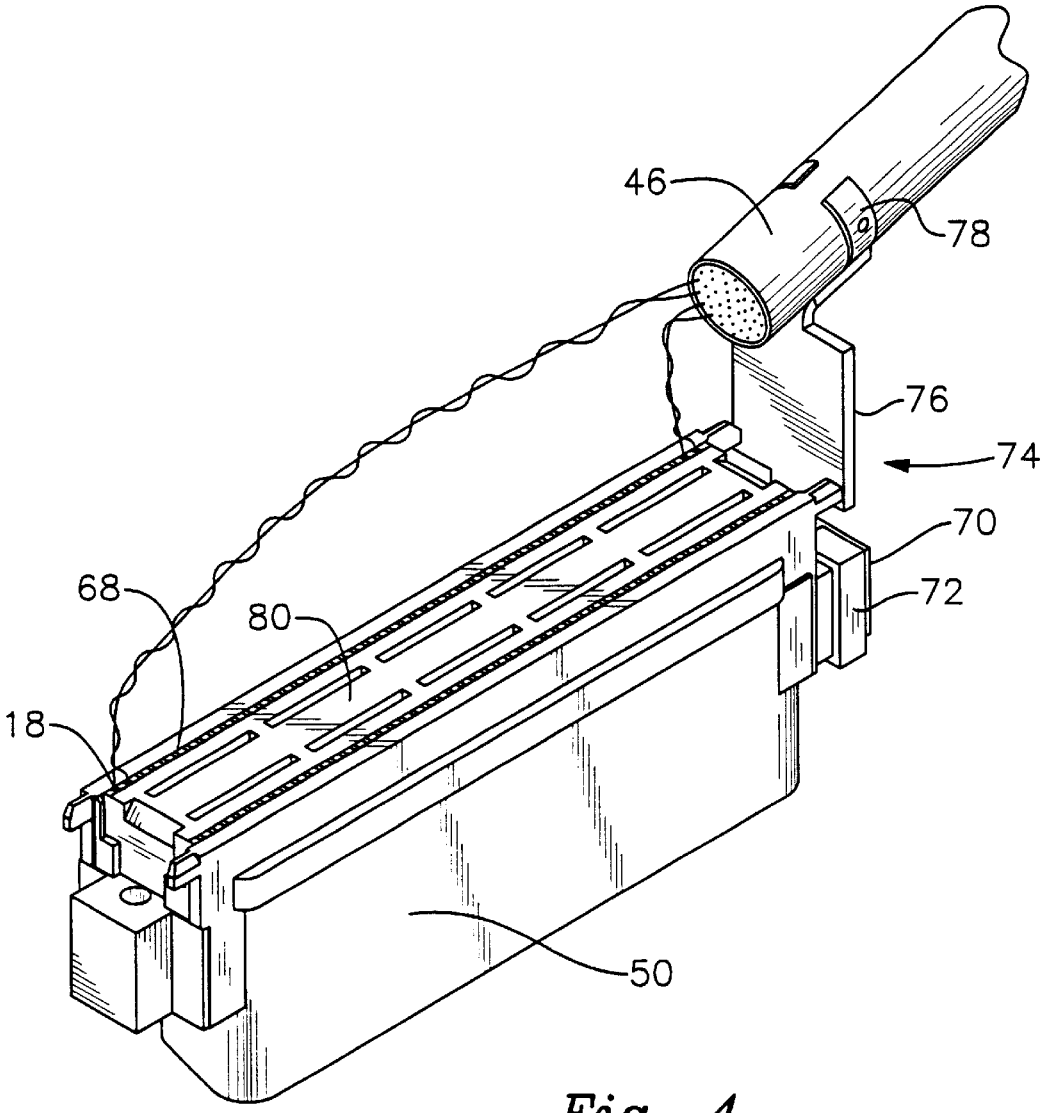
FIG. 4 is a pictorial view of the connector of FIG. 3, but with the entire hood removed for illustrative purposes.
Figure 5:
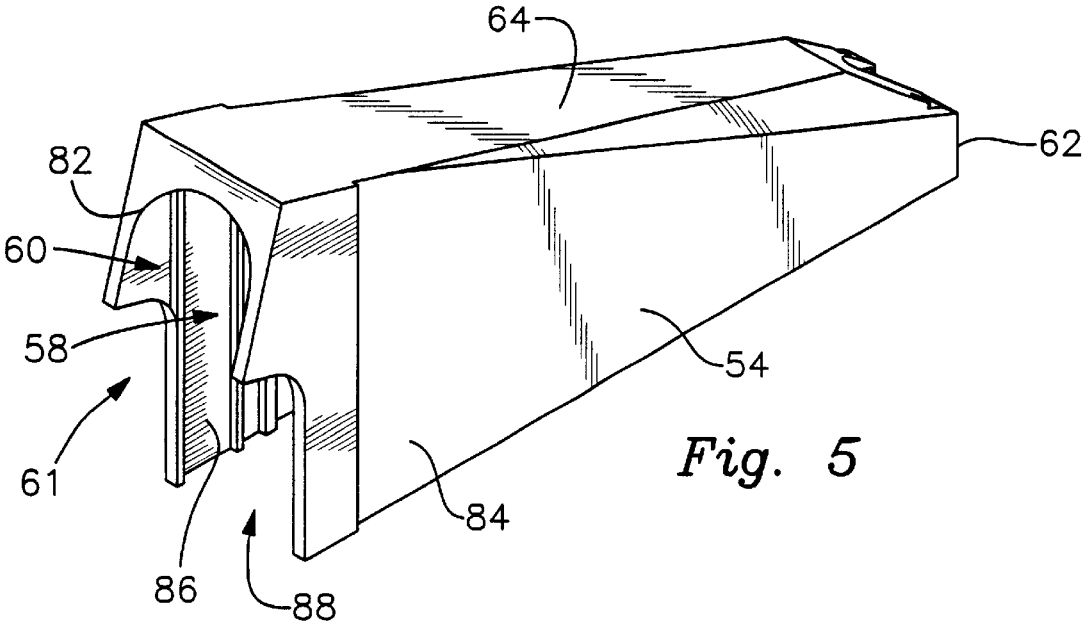
FIG. 5 is a pictorial view of the hood of the present invention.
Figure 6:
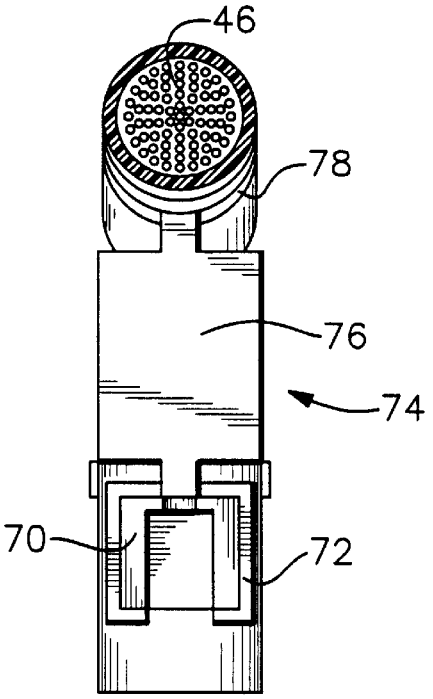
FIG. 6 is a front elevational view of the connector of FIG. 4.

As can be seen from FIG. 5, opening 60 of hood 54 includes a rounded lip 82 to accommodate the round cable 46. Hood 54 also includes side walls 84 and 86 which form the remainder of enclosure or cavity 58. The bottom 88 of hood 54 is open for receiving the top surface 80 of base 50. Plate 76, which is shown in FIGS. 4 and 6, is located below opening 60 and forms the bottom edge of opening 60 and is useful in preventing foreign matter from penetrating into cavity 58.

This invention enables one to mate the first half 38 of the ribbon connector 34 with its second half 42 without the need to bend the cable 46, i.e., adjacent ribbon connector 36 will not interfere with the cable because of the angled exit of the cable from the hood 54. In addition, because of this design, the first halves 38 and 40 of the connectors 34 and 36 may be spaced closer, thereby enabling higher density circuit paths on the circuit board and thus a smaller board, and in addition, the connector itself may be shortened.

From the foregoing description of the preferred embodiment of the invention, it will be apparent that many modifications may be made therein. It will be understood, however, that this embodiment of the invention in an exemplification of the invention only and that the invention is not limited thereto. It is to be understood therefore that it is intended in the appended claims to cover all modifications as fall within the true spirit and scope of the invention.

What is claimed is:

1. An electrical connector for use in connecting an electrical cable, having a plurality of wires, to an associated substrate, the electrical connector comprising:

a first connector half and a second connector half; said first connector half is selectively connectable to the associated substrate;

a base forming a part of said second connector half; said base carrying a plurality of electrical contacts terminating said plurality of wires for making an electrical connection to said associated substrate;

a mechanism juxtaposed to said base; said mechanism receiving and holding the electrical cable at an angle greater than 0° but less than 90° relative to said base; and a removable hood selectively connectable with said base to cover said base and to form an enclosure with said base; said hood being a separate element from said base;

wherein said base is a separate element from said mechanism;

wherein said base includes a stud extending from said base; said mechanism includes a first clamp for selectively connecting said mechanism to said stud.

2. An electrical connector as set forth in claim 1, wherein said hood is a separate element from said mechanism.

3. An electrical connector as set forth in claim 1, wherein said mechanism includes and a second clamp for selectively connecting said mechanism to said electrical cable; and said hood includes an opening for adapting the hood to receive the electrical cable.

4. An electrical connector as set forth in claim 3, wherein said first clamp of said mechanism together with said opening of said hood guide and hold said electrical cable at said angle greater than 0° but less than 90° relative to said base; and said mechanism provides strain relief to said electrical cable.

5. An electrical connector as set forth in claim 4, wherein said hood is sloped downwardly from a cable receiving side adjacent said opening toward a side of the hood opposite the cable receiving side.

6. An electrical connector as set forth in claim 5, wherein said mechanism defines a substantially planar portion; said planar portion together with said hood and said base forming said enclosure for protecting the plurality of wires of said electrical cable.

* * * * *